US010195761B2

(12) United States Patent
Sherwood et al.

(10) Patent No.: US 10,195,761 B2
(45) Date of Patent: Feb. 5, 2019

(54) METHOD AND DEVICE FOR MANUFACTURING A REINFORCEMENT FOR COMPOSITE MATERIAL MADE FROM NATURAL FIBERS AND REINFORCEMENT OBTAINED USING SUCH A METHOD

(71) Applicant: COBRATEX, Toulouse (FR)

(72) Inventors: Edouard Sherwood, Toulouse (FR); David Hardy, Merenvielle (FR)

(73) Assignee: COBRATEX, Toulouse (FR)

( * ) Notice: Subject to any disclaimer, the term of this patent is extended or adjusted under 35 U.S.C. 154(b) by 915 days.

(21) Appl. No.: 14/370,023

(22) PCT Filed: Dec. 27, 2012

(86) PCT No.: PCT/EP2012/076980

§ 371 (c)(1),
(2) Date: Jun. 30, 2014

(87) PCT Pub. No.: WO2013/098346

PCT Pub. Date: Jul. 4, 2013

(65) Prior Publication Data

US 2014/0370288 A1 Dec. 18, 2014

(30) Foreign Application Priority Data

Dec. 28, 2011 (FR) ..... 11 62507

(51) Int. Cl.
*B27J 1/00* (2006.01)
*B27D 1/10* (2006.01)
(Continued)

(52) U.S. Cl.
CPC *B27J 1/00* (2013.01); *B27D 1/10* (2013.01); *B27J 1/003* (2013.01); *B27L 5/00* (2013.01);
(Continued)

(58) Field of Classification Search
CPC .... B27D 1/10; B27J 1/00; B27J 1/003; Y10T 428/24132; Y10T 428/24777; Y10T 428/298
See application file for complete search history.

(56) References Cited

U.S. PATENT DOCUMENTS 5,868,184 A * 2/1999 Van Elten ..... B27L 11/04 144/124
2007/0116940 A1 5/2007 Ou et al.
(Continued)

FOREIGN PATENT DOCUMENTS

| | | | |
|---|---|---|---|
| DE | 253376 | C | 1/1911 |
| EP | 2199045 | A1 | 6/2010 |
| WO | 2008/066386 | A1 | 6/2008 |

*Primary Examiner* — Gerard Higgins
(74) *Attorney, Agent, or Firm* — Im IP Law; C. Andrew Im; Chai Im

(57) ABSTRACT

A method for making a fibrous strip configured for making a ribbon with a thickness ranging between 0.1 mm and 1 mm and a width ranging between 2 mm and 10 mm. The ligneous logs or cans are cut into square-edged plank with a pre-defined length. The strip is separated from a surface of the square-edged plank by an orthogonal cutting process. The depth of cut is equal to the thickness of the strip. The cutting speed direction is parallel to the fibers of the square-edged plank. Also, a fibrous reinforcement is obtained using the method and a device for implements the method.

7 Claims, 3 Drawing Sheets

(51) Int. Cl.
*B27L 5/00* (2006.01)
*B27L 5/06* (2006.01)

(52) U.S. Cl.
CPC ..... *B27L 5/008* (2013.01); *B27L 5/06* (2013.01); *Y10T 428/24132* (2015.01); *Y10T 428/24777* (2015.01); *Y10T 428/298* (2015.01)

(56) References Cited

U.S. PATENT DOCUMENTS

2007/0122616 A1 5/2007 Lawson et al.
2009/0308528 A1 12/2009 Sullivan

* cited by examiner

METHOD AND DEVICE FOR MANUFACTURING A REINFORCEMENT FOR COMPOSITE MATERIAL MADE FROM NATURAL FIBERS AND REINFORCEMENT OBTAINED USING SUCH A METHOD

RELATED APPLICATIONS

This application is a § 371 application from PCT/EP2012/076980 filed Dec. 27, 2012, which claims priority from French Patent Application No. 11 62507 filed Dec. 28, 2011, each of which is herein incorporated by reference in its entirety.

TECHNICAL FIELD OF THE INVENTION

The invention relates to a method and device for manufacturing a reinforcement for composite material made from natural fibers, particularly bamboo, and a reinforcement obtained using such a method. The invention is more particularly, but not exclusively, suitable for manufacturing reinforcing fabric made of bamboo in the form of a ribbon of fibers. The invention is also applicable to the making of reinforcements, particularly in the form of fabric, made from ligneous fibers of all types.

BACKGROUND OF THE INVENTION

The use of natural fibers for making composite material reinforcements is known from prior art. Such fibers, particularly bamboo fibers, are used in the form of chips in laminated panels. The document US 2007 0116 940 describes such a laminated panel comprising strands taken from canes using a cutting process. Such an application does not call for great precision or great reproducibility in the dimensions of said strands, or in the direction of said strands in relation to the bamboo fibers.

The document US 2009/308528 describes the making of an article by stratifying thick bamboo strips, with a section of approximately 160 $mm^2$ and a length of approximately 250 mm. Said strips are sufficiently thick and rigid to be made using sawing techniques without leading to any significant deformation of the strips during the cutting operation. These strips are far too rigid to be suitable for making a reinforcing fabric for a composite material.

The document WO 2008/066386 describes a method for making a mat made of bamboo, which is obtained by assembling strips that are sufficiently thick and rigid to undergo a thickness calibration operation by means of machining after they are extracted from the cane. Thus, said strips according to the prior art are strictly thicker than 1 mm and preferably between 1 mm and 2.5 mm thick, with width approximately 15 mm.

Thus, these documents of the prior art describe the making of articles from bamboo fibers, where the mechanical characteristics are those of said fibers, which may be assembled if required. This invention is aimed at making a bamboo fiber reinforcement that is capable of being incorporated in the form of a fibrous reinforcement in a matrix in order to make up a composite material, that is to say a material with characteristics that are the result of synergy between the reinforcement and the matrix, for both its implementation and its technical characteristics The use of natural fibers for making a reinforcement intended for making up a high-performance composite material necessitates both sufficiently long fibers to make continuous reinforcements and consistency in dimensions as well as in terms of mechanical properties, to predict the response of the composite to the loads to which it is subjected depending on the reinforcement ratio and directions.

Fiber removal technologies using the explosion or crushing of ligneous products mix and damage the fibers of said products, and thus produce fibers with variable properties, which may have surface defects that can deteriorate their mechanical characteristics.

OBJECT AND SUMMARY OF THE INVENTION

The invention is aimed at remedying the drawbacks of the prior art and therefore relates to a ribbon of ligneous fibers consisting in an assembly of strips of fibers with a calibrated thickness ranging between 0.1 mm and 1 mm, and an equally calibrated width ranging between 2 mm and 10 mm, where the length, density and direction of said strips are calibrated, and the strips are extracted using a cutting process that comprises the displacement of a cutting edge parallel to the fiber direction. Thus, the ribbon of fibers according to the invention is perfectly directed in relation to the fibers and can reach an infinite length regardless of the dimension of the logs from which the strips are extracted. The use of a cutting method involving a tool comprising a definite cutting edge makes it possible to obtain calibrated strips, the fibers of which are free of defects such as tearing cuts, particularly at the surface of the ribbon.

The invention also relates to a method for making a fibrous strip that is adapted to be used for making up the ribbon according to the invention, which method comprises the steps of:

a. cutting the ligneous logs or canes into a square-edged with a definite length;
b. separating the strip from a surface of the square-edged by an orthogonal cutting process with a depth of cut that is substantially equal to the thickness of the strip, where the cutting speed is parallel to the fibers of the square-edged.

Thus, the cutting operation makes it possible to separate strips free of curls or fiber breaks due to the cutting operation inside said strips.

The term 'orthogonal cutting' conventionally means a material-removing operation carried out by a cutting tool with a definite cutting edge, with a constant rake angle and wedge angle over the entire length of the cutting edge, wherein said edge is perpendicular to the direction of the cutting speed, and the geometric conditions of the contact between the material are such that the speed profile in a section of the chip along a plane perpendicular to the rake face of the tool is substantially constant. Thus, the absence of a speed gradient in the width of the chip prevents said chip from curling. The term 'depth of cut' defines the depth of penetration of the cutting edge of the tool in the material. In an orthogonal cutting process, such depth of cut is measured in a direction that is perpendicular both to the cutting edge and the cutting speed vector. The chip thickness, which is the thickness of the strip, is substantially equal to the depth of cut when the process of separating the chip from the material is particularly carried out in mode I. Thus, the thickness of the strips is easily calibrated by controlling the depth of cut.

The invention also relates to a device for implementing the method according to the invention, wherein the device comprises:

i. a cutting blade comprising a cutting edge and means for holding said blade in position;

ii. means for moving said cutting blade in an alternating displacement movement in a direction perpendicular to said cutting edge;

iii. means for holding the square-edged and opposing the force generated during cutting;

iv. means for moving, in a movement known as the feed movement, the blade perpendicular to the edge and perpendicular to the cutting movement.

Thus, the device according to the invention makes it possible, by combining the cutting and feed movements with the geometry of the cutting edge, to obtain strips with a perfectly calibrated width, length and thickness.

The invention can be implemented in the advantageous embodiments described below, which may be considered individually or in any technically operative combination.

Advantageously, the ribbon according to the invention is made of bamboo fibers. These fibers have high mechanical characteristics, and the rapid growth characteristics of the plant make it possible to have large quantities of raw material.

In a preferred embodiment of the ribbon according to the invention, its thickness ranges between 0.1 mm and 1 mm. Thus, the rigidity of said ribbon can be adapted for the intended application, wherein said ribbon is at least one fiber thick.

Advantageously, the width of the ribbon according to the invention ranges between 2 mm and 10 mm. That width range may be obtained by extracting the strip, including in canes with small diameters, so that the width of the ribbon is the width of a single strip.

Advantageously, the method according to the invention comprises, during step (b), a step of sorting the strips according to their cutting depth in the square-edged. Such sorting makes it possible to obtain reinforcements with uniform and reproducible properties.

In a first embodiment of the method according to the invention, which is suitable for implementing strips that are more than 1 mm wide, said method comprises, at the end of steps (a) and (b), the steps of:

c. aligning the strips according to their fiber direction;

d. assembling said strips so as to constitute a ribbon.

Thus, said method makes it possible to make infinite and strong ribbons from short strips, therefore with uniform properties on the scale of the strip.

In a first advantageous embodiment of steps (c) and (d), the strips are lined up during the step (c) along two stacked layers, and the ribbon is obtained in step (d) by joining the two layers of strips by their sides so that each strip of a layer is joined to two strips, and the joining interfaces of any one strip with the two other strips are located on the same side at each end of said strip. This embodiment makes it possible to obtain a particularly strong ribbon.

In a second advantageous embodiment of steps (c) and (d) the strips are assembled into a ribbon so that within said ribbon, each strip is assembled to two stacked strips at each of its ends, wherein the joining interfaces of any one strip with the other two strips are located on opposite sides at each end of said strip. This embodiment makes it possible to obtain a more flexible ribbon.

In a third embodiment of steps (c) and (d), the strips are aligned in juxtaposition during step (c) and assembled by their ends during step (d) so as to make the ribbon. This embodiment makes it possible to obtain a ribbon with a uniform thickness over its entire length.

In another advantageous embodiment that makes it possible to make a ribbon with substantially uniform thickness over its length, the juxtaposed strips are assembled by compression at their stacked ends. This embodiment also makes it possible to increase the density of the fibers in the assembly area.

Advantageously, the method according to the invention comprises, after step (d), a step of:

e. winding up the ribbon made in step (d) into a reel.

Thus, said ribbon may be used on automatic machines for weaving or making pre-impregnated materials.

Advantageously, the method according to the invention comprises, after step (e), a step of:

f. weaving the ribbon so as to make reinforcing fabric.

In a second embodiment of the method according to the invention, the thickness and width of the strips range between 0.1 mm and 0.5 mm and it comprises, after step (b), a step of:

g. sizing the strips made in step (b);

h. spinning the sized strips so as to obtain continuous fiber.

Thus, the method according to the invention makes it possible, in this embodiment, to make reinforcements in the form of continuous fibers.

Advantageously, the cutting edge of the blade of the device according to the invention comprises a plurality of parallel cutting segments. Thus, several strips can be made in a single travel of the blade.

Advantageously, the cutting edge of the blade of the device according to the invention is materialized by the intersection of a rake face and a flank face, wherein said flank face is parallel to the direction of the cutting speed and the cutting edge. Thus, the thickness of the extracted strip is adjusted by the contact between the blade and the cutting surface of the square-edged independently from the edge of that section.

Advantageously, the device according to the invention comprises:

v. means for measuring the sum of the number of depth of cuts from the first strip extracted from the square-edged;

vi. means for collecting the strips produced and sorting them depending on the sum of the number of depth of cuts corresponding to their production.

Thus, the device makes it possible to sort the strips according to their properties as soon as they are extracted from the square-edged.

BRIEF DESCRIPTION OF THE DRAWINGS

The invention is described below in its preferred embodiments, which are not limitative in any way, and by reference to FIGS. 1 to 12, wherein:

FIG. 3A is a front view before the implementation of the method according to the invention, FIG. 3B is a perspective view during the implementation of the method according to the invention;

DETAILED DESCRIPTION OF THE EMBODIMENTS

Figure 1:
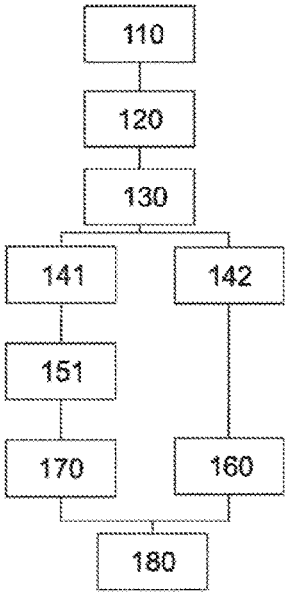
FIG. 1 represents a chart of the method according to the invention.

In FIG. 1, in an example of the overall execution of the method according to the invention, after the raw material (110) is received, it is debited into square-edged during a cutting step (120). The fibers are then removed from said square-edged during a mechanical fiber removal step (130) consisting in extracting strips using an orthogonal cutting process with a blade with a geometrically defined cutting edge.

Depending on the nature of the blade and the cutting conditions used for removing the fibers, the strips obtained are of two types:

- strips with a width that is substantially larger than their thickness, that is to say width at least 10 times greater than the thickness;
- strips with a width that is of the same order of magnitude as their thickness Each of these two semi-finished products comprises a plurality of ligneous fibers of the raw material.

The first type of strip is assembled during an assembly step (142) so as to form a ribbon. In this exemplary embodiment, said ribbon is then wound into a reel during a packaging step (160); other packaging modes may be used.

In the case of the second type of strips, they are sized during a sizing step (141). They are then spun during a spinning step (151) so as to constitute a fibrous reinforcement in the form of continuous threads or reinforcing fibers before they are also packaged (170).

The reinforcing fibers and ribbons may then undergo weaving or miscellaneous assembly operations (180) in order to constitute reinforcements suitable for making up composite materials.

Figure 2:
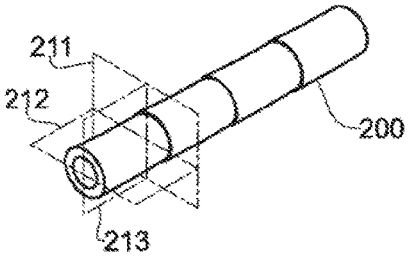
FIG. 2 is a perspective view of a bamboo cane used as the raw material in one embodiment of the invention.

In FIG. 2 of an exemplary embodiment of the method according to the invention, the raw material used takes the form of a bamboo cane (200). During the cutting step, said cane (200) is cut into sections and split along planes (211, 212, 213) that are substantially orthogonal so as to make square-edged. The number of splitting planes (212, 213) depends on the diameter of the cane (200).

Thus, canes with small diameters are only split in two. Canes with larger diameters can be split into four, six or even more, if the diameter of the cane or log is very large.

Figure 3:
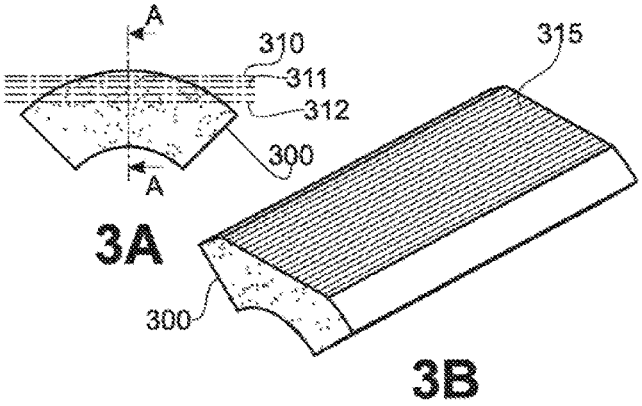
FIG. 3 is an example of the square-edged extracted from the raw material of FIG. 2.

In FIG. 3, the strips are separated from the square-edged (300) by means of a mechanical cutting process with successive layers (310, 311, 312), so that the cutting surface (315) is substantially parallel to the fiber direction.

Figure 4:
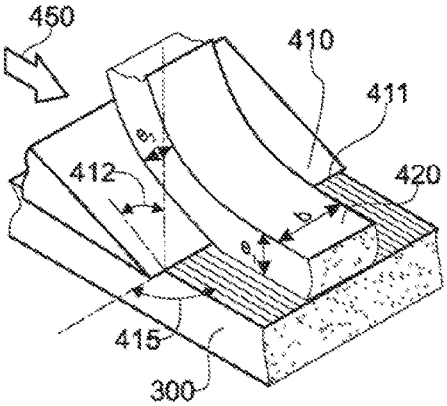
FIG. 4 is a perspective view of an example of an orthogonal cutting process implemented for extracting a strip from a square-edged according to an exemplary embodiment of the method according to the invention.

In FIG. 4, the strips (420) are separated from the square-edged (300) by an orthogonal cutting process. That cutting process is carried out by a cutting tool (410) or blade, comprising a cutting edge (411). The cutting process is defined by its direction in relation to the overall direction of the fibers of the square-edged (300); that cutting direction is 90-0, that is to say the cutting edge (411) is directed along an angle (415) of 90° in relation to the fiber direction and the cutting speed (450), being the relative movement speed between the tool and the square-edged, is parallel to said fiber direction.

Here, fiber direction means the majority direction of the fibers of the section, because the square-edged is made from a natural product and the ligneous fibers may individually and locally deviate substantially from the fiber direction.

The kinematic and geometric conditions of cutting are fixed depending on the material and particularly its humidity rate, so as to extract the strip (420) using a separation mode known as the type I mode. Thus, the strip is not sheared along its thickness, which thickness ($e_2$) of the strip (420) is equal to the depth of cut (e1)) of the blade (410) in the square-edged (300). To allow this material separation mode, the rake angle (412) measured in relation to the normal at the cutting surface is greater than 20° and preferably greater than 30°. The cutting speed (450) ranges between 0.015 $m \cdot s^{-1}$ and 1 $m \cdot s^{-1}$, preferably between 0.025 $m \cdot s^{-1}$ and 0.05 $m \cdot s^{-1}$. These conditions make it possible to separate the strips using a type I mode without damaging the fibers in said strips, with a depth of cut ($e_1$) ranging between 0.1 mm and 1 mm, corresponding to the thicknesses required. The kinematic and geometric conditions of orthogonal cutting make it possible to obtain a uniform flow speed field along the width (b) of the strip (420), which strip is thus free of curling.

Figure 5:
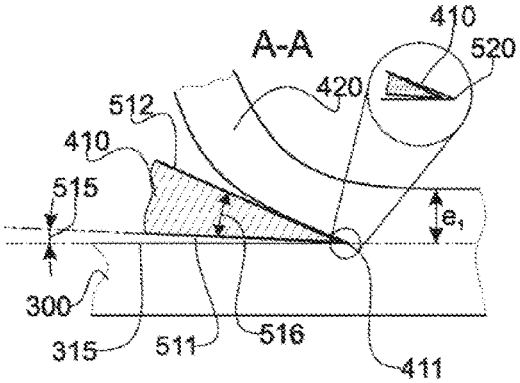
FIG. 5 is a side view along a section AA, defined in FIG. 3A, of an orthogonal cutting process with a type I separation mode of the strip.

In FIG. 5, along a section perpendicular to the cutting edge (411) and parallel to the cutting speed (450), the type I separation mode is achieved by separating the strip (420) from the cutting surface by propagating an opening (520) before the cutting edge (411) of the blade (410). The cutting edge (411) is defined by the intersection of the rake face (512) and the flank face (511) of the blade. The flank face is turned at a flank angle (515) measured between the flank face and the cutting surface (315). The angle (516) between the rake face and the flank face defines the wedge angle of the blade. In each section perpendicular to the cutting edge, the sum of the rake angle (412), the wedge angle (516) and the flank angle (515) is equal to 90°. According to the orthogonal cutting process used for extracting a strip (420) implemented by the method according to the invention, the rake angle (412) and the flank angle (515) of the blade are constant over the width of the extracted strip.

Figure 6:
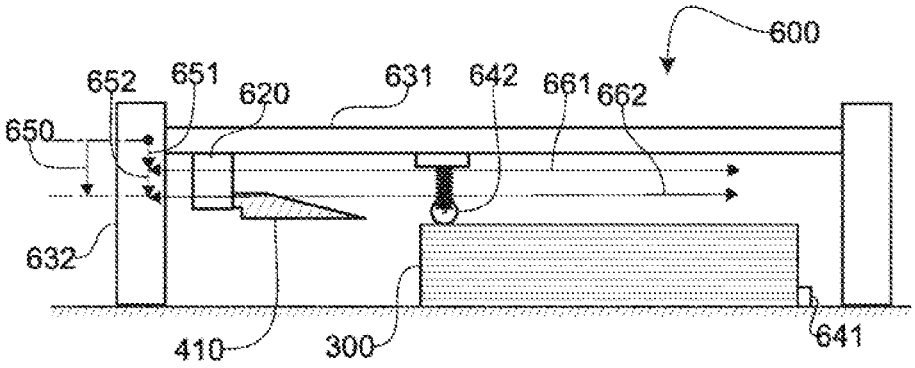
FIG. 6 is a side view of a schematic exemplary embodiment of the device according to the invention.

In FIG. 6, the device (600) according to the invention comprises a carriage (620) capable of supporting the blade (420). Motor-driving and guiding means (631) make it possible to move said carriage (620) along a cutting movement and control the cutting speed. Motor-driving and guiding means (632) make it possible to communicate the engagement movement to the carriage (620). The cutting cycle comprises a feed movement (651) followed by a to-and-fro cutting movement (661) along the square-edged (300) at the defined cutting speed. The strip is created during the outward movement. When the carriage (620) supporting the blade (410) returns to its initial position, a new feed movement (652) is applied to the carriage, which carries out another to-and-fro movement on the square-edged (300) so as to create a new strip and so on. In this embodiment, the length of the strip created is equal to that of the square-edged. That length may be controlled by making a square cycle, with a clearance movement contrary to the feed movement (651, 652) after the outward movement and before the return movement. The device also comprises means to measure the total number (650) of depth of cuts. Because the mechanical properties of fibers vary depending on their position in a cane of bamboo, the strips are advantageously sorted on the basis of their position of extraction using that information (650) relating to the total number of depth of cuts. The square-edged plank (300) is placed in the device according to the invention and held in position by means (641) that oppose the cutting force. Those means for holding in position do not completely join the square-edged (300) with the device. In this exemplary embodiment, the flank angle of the blade (410) is 0°, so that the flank face is in contact with the cutting surface along a surface that is substantially flat. The square-edged is not fixed, and it turns naturally along its fiber direction, so that the cut is made using a 90-0 mode, which is the easiest cutting mode. A pressure roller (642) that moves at the same time as the blade-holder carriage (620) cooperates with the flank face and the means (641) for holding the square-edged to stabilize it during cutting.

Figure 7:
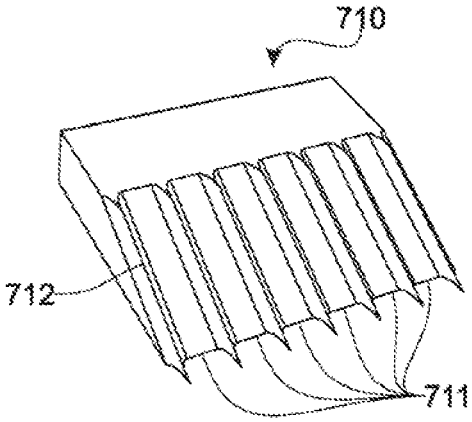
FIG. 7 is a perspective view of an exemplary embodiment of a blade comprising a plurality of cutting edges.

In FIG. 7, in one embodiment, the blade (710) of the device according to the invention comprises a plurality of cutting edges (711) so as to extract several parallel strips using an orthogonal or semi-orthogonal cutting process during the same movement of said blade (711) on the square-edged. The cutting edges (711) of the plurality are separated from each other by separating edges (712), projecting and extending from the rake face or the flank face, which cut the strips laterally before the extraction cut, so that the extraction cut is always an orthogonal cut. Thus, the width of the strips depends on the length of each cutting edge (711) of the plurality. For making ribbons, the width of said strips ranges between 1 mm and 10 mm, and the depth of cut is in such a case selected below $1/10^{th}$ of the width of the strip.

Figure 8:
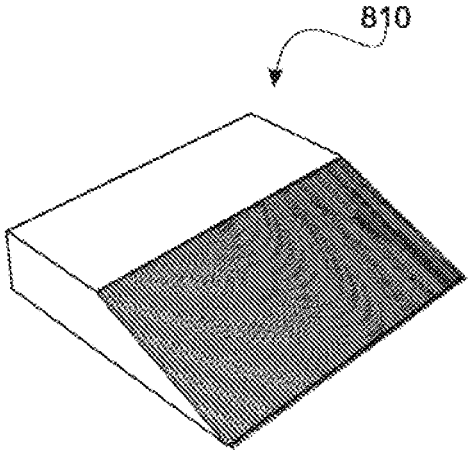
FIG. 8 is a perspective view of an exemplary embodiment of a blade suitable for extracting reinforcing fibers.

In FIG. 8, in another embodiment, the blade (810) comprises cutting edges with lengths ranging from 0.1 mm to 0.5 mm; such a blade (810) combined with depth of cuts of the same order of magnitude makes it possible to extract reinforcing fibers.

Figure 9:
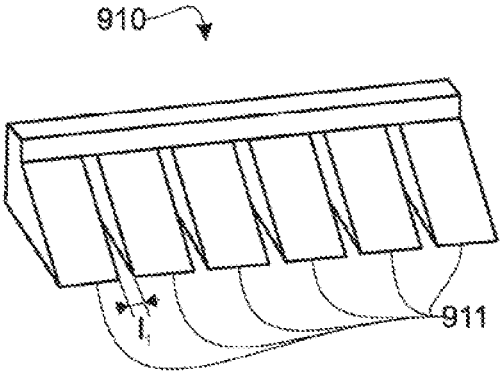
FIG. 9 is a perspective view of an alternative exemplary embodiment of a blade suitable for extracting strips.

In FIG. 9, in another exemplary embodiment, the blade (910) comprises a plurality of cutting edges (911) separated by spaces with a width $l_1$. The cut is then semi-orthogonal but the sharpness of the corners of edges and the symmetry from one cut to another makes it possible to retain a separation mode of type I and the absence of curling or shearing in the thickness of the strip. In order to retain a flat cutting surface, the use of this type of blade (910) comprises, in a particular embodiment, movements during which the blade (910) is laterally offset parallel to the cutting edges (911) with a value at least equal to $l_1$.

Figure 10:
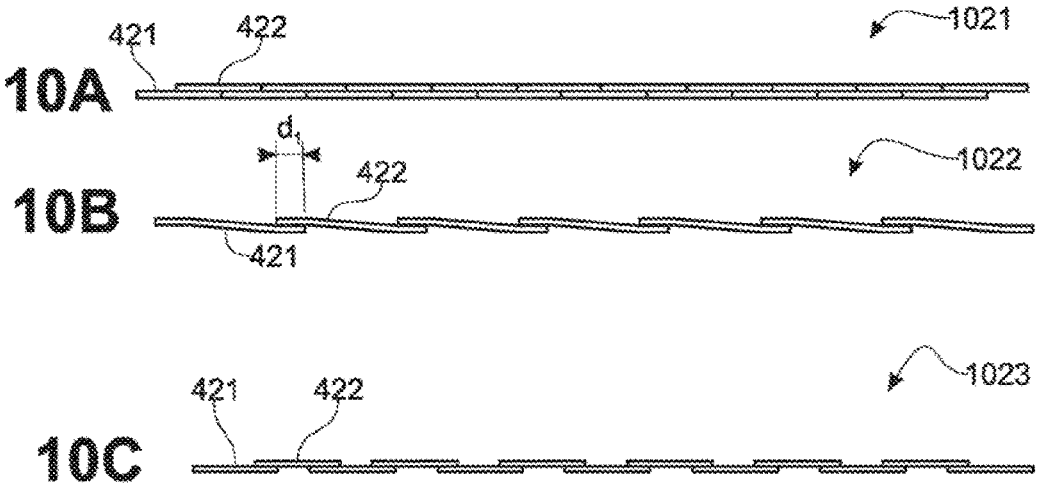
FIG. 10 is a side view along the edge of the ribbon of three embodiments, FIGS. 10A to 10C, of a ribbon from strips assembled by stacking, in an exemplary embodiment of the method according to the invention.

In FIG. 10, in a first exemplary embodiment, in a case of extraction of wide strips (421, 422), the strips are assembled in two layers with one side against another so as to make up ribbons (1021, 1022, 1023). In FIG. 10A, in a first alternative of the ribbon (1021) according to the invention, the strips (421, 422) of the two layers are assembled one side against another in staggered formation so that the assembly is carried out over the totality of the surface of the sides of the strips. This embodiment makes for a ribbon (1021) that is mechanically stronger.

In FIG. 10B, in a second alternative of the ribbon (1022) according to the invention, the strips (421, 422) are assembled one side against another, alternating the assembly side at each end of each strip. Compared to the previous alternative embodiment (FIG. 10A), the overlap of the strips at the assembly interface is small but at least greater than 0.5 mm. That alternative embodiment makes for a ribbon (1022) that is more flexible.

In FIG. 10C, in a third alternative embodiment of the ribbon (1023) according to the invention, the strips (421, 422) of the two layers are assembled so as not to be butt-jointed but so that each strip is joined to two others by at least half the surface of its side. In that example, the assembly interface is placed on the same side of a strip at its two ends. That alternative embodiment offers a compromise between the flexibility of the ribbon and its mechanical properties.

The method for assembling the two strip layers (421, 422) is selected depending on the intended application of the reinforcement. Assembly methods using gluing, spunlace or compression are, for example and without limitation, suitable for making such an assembly.

Figure 11:
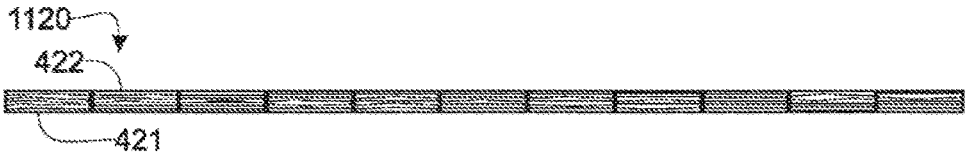
FIG. 11 is a top view of an exemplary ribbon obtained in one exemplary embodiment of the method according to the invention, wherein the strips are assembled by juxtaposition.

In FIG. 11, in a second embodiment of the ribbon (1120) according to the invention, the strips (421, 422) that make up said ribbon are assembled by their ends. That embodiment makes it possible to obtain a very flexible and fine ribbon, with thickness that is substantially constant over the entire length of said ribbon (1120). That assembly is preferably made by gluing.

Figure 12:
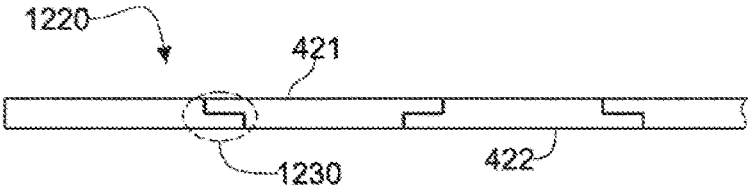
FIG. 12 is a side view of an exemplary ribbon obtained in one embodiment of the method according to the invention, wherein the assembled ends of the strips are compressed.

In FIG. 12, in another exemplary embodiment of the ribbon (1220) according to the invention, the strips (421, 422) are assembled by their ends in a compression zone (1230), which makes it possible to increase the density of fibers in said compressed zone (1230) and obtain a ribbon with a uniform thickness.

Regardless of the embodiment, the ribbon resulting from the assembly of strips can be wound into a reel.

In the case of the extraction of reinforcements in the form of fibers, the fibers are spun after sizing with greasy products, in order to constitute a continuous reinforcing fiber.

The reinforcing fibers and the ribbons can then be used to constitute reinforcements, for example in the form of fabric, suitable for making a composite material with a thermosetting or thermoplastic matrix. The flexibility of the fibers is sufficient for using the techniques for implementing these materials, particularly by automatic laying up and stratification of pre-impregnated plies, thermoforming or injection or infusion of resin in preforms known as dry preforms.

The invention claimed is:

1. A method for making a plurality of fibrous strips and a ribbon of ligneous fibers comprising an assembly of the plurality of fibrous strips, wherein the ribbon has a calibrated thickness ranging between 0.1 mm and 1 mm, and equally an calibrated width ranging between 2 mm and 10 mm, comprising the steps of:

cutting ligneous logs or canes into square-edged planks, each having a predefined length; and separating the plurality of strips from a surface of one of the square-edged planks by an orthogonal cutting process with a depth of cut substantially equal to the thickness of each of the plurality of strips, wherein cutting is parallel to the fibers of the square-edged plank, and wherein the width of the plurality of the strips is more than 1 mm;

aligning the plurality of the strips according to their fiber direction;

assembling the plurality of the strips to make the ribbon;

winding the ribbon into a reel; and weaving the wound ribbon to make a reinforcing fabric.

2. The method according to claim 1, wherein the ribbon is made of bamboo fibers.

3. The method according to claim 1, comprising the step of sorting each of the plurality of the strips according to their thickness.

4. The method according to claim 1, wherein the step of aligning the plurality of strips comprises aligning the plurality of strips in a stack of two layers of strips, and the step of assembling the plurality of strips comprises joining the two layers of strips at a surface, wherein a strip of a first layer of the two layer of strips is joined to two strips of a second layer of the two layers of strips, and wherein the joining of the strip of the first layer with the two strips of the second layer is located on the same surface of the strip of the first layer.

5. The method according to claim 1, wherein the step of assembling the plurality of strips into a ribbon comprises assembling a first strip of the plurality of strips to a second strip and a third strip of the plurality of strips at opposite ends of said first strip; and wherein said second strip and said third strip are joined to a top surface and a bottom surface, respectively, of said first strip.

6. The method according to claim 1, wherein the step of aligning the plurality of strips comprises aligning the plurality of strips in juxtaposition and wherein the step of assembling the plurality of strips comprises assembling the plurality of strips at their ends.

7. The method according to claim 1, further comprising the steps of assembling juxtaposed strips by compression at their stacked ends so that a thickness of the ribbon is uniform over its length.

* * * * *